US010327483B2

(12) United States Patent
Messier et al.

(10) Patent No.: US 10,327,483 B2
(45) Date of Patent: Jun. 25, 2019

(54) EXTENDER FOR AN OUTERWEAR

(71) Applicant: EXTENDHER LLC, Clifton Park, NY (US)

(72) Inventors: Maria T Messier, Clifton Park, NY (US); Joanne D Frank, Schenectady, NY (US)

(73) Assignee: EXTENDHER LLC, Clifton Park, NY (US)

( * ) Notice: Subject to any disclaimer, the term of this patent is extended or adjusted under 35 U.S.C. 154(b) by 0 days.

(21) Appl. No.: 15/109,529

(22) PCT Filed: Dec. 31, 2015

(86) PCT No.: PCT/US2015/068210

§ 371 (c)(1),
(2) Date: Jul. 1, 2016

(87) PCT Pub. No.: WO2016/109761

PCT Pub. Date: Jul. 7, 2016

(65) Prior Publication Data

US 2018/0110268 A1 Apr. 26, 2018

Related U.S. Application Data

(60) Provisional application No. 62/099,450, filed on Jan. 3, 2015.

(51) Int. Cl.
*A41D 15/00* (2006.01)
*A41D 3/02* (2006.01)
(Continued)

(52) U.S. Cl.
CPC ..... *A41D 15/002* (2013.01); *A41D 1/21* (2018.01); *A41D 3/02* (2013.01); *A42B 1/048* (2013.01);
(Continued)

(58) Field of Classification Search
CPC ..... A41D 15/02; A41D 15/007; A41D 15/04; A41D 1/21; A42D 2300/33; A42D 2300/322; A42D 2400/482
See application file for complete search history.

(56) References Cited

U.S. PATENT DOCUMENTS 514,720 A * 2/1894 Macgowan ..... A41D 1/22 2/105
2,320,783 A * 6/1943 Lee ..... A41D 15/002 2/94
(Continued)

FOREIGN PATENT DOCUMENTS

CN 202819689 U 3/2013
FR 2889652 A1 2/2007

OTHER PUBLICATIONS http://www.yarnfwd.com/childsiz.html, Yarn Forward, 2001.*

*Primary Examiner* — Shaun R Hurley
*Assistant Examiner* — Bao-Thieu L Nguyen
(74) *Attorney, Agent, or Firm* — Zareefa B. Flener; Flener IP & Business Law

(57) ABSTRACT

An extender for an outerwear is described. The extender includes a first section and a second section. The first section provides a tapered first side and a substantially straight second side. The second section provides a tapered first side and a substantially straight second side. The extender also includes a fastening arrangement adapted to removably secure the second side of the first section to the second side of the second section. The extender also includes an anchoring arrangement arranged on the first side of the first section and the first side of the second section. The anchoring arrangement is adapted to removably secure the first section and the second section to first and second seams of the outerwear.

4 Claims, 5 Drawing Sheets

(51) Int. Cl.
*A41D 1/21* (2018.01)
*A42B 1/04* (2006.01)

(52) U.S. Cl.
CPC .... *A41D 2300/20* (2013.01); *A41D 2300/322* (2013.01); *A41D 2300/33* (2013.01); *A41D 2400/482* (2013.01)

(56) References Cited

U.S. PATENT DOCUMENTS 2,479,091 A * 8/1949 Ackley ..... A41D 15/00 2/74
2,582,772 A * 1/1952 Egbert ..... A41D 3/00 2/103
2,636,176 A * 4/1953 Ross ..... A41D 3/02 2/93
2,779,944 A * 2/1957 Flach ..... A41D 15/00 2/85
3,997,982 A * 12/1976 Holland ..... G09B 25/00 2/102
4,494,248 A * 1/1985 Holder ..... A41D 13/1245 2/114
4,665,564 A * 5/1987 Bogart ..... A61F 5/055 2/115
4,683,595 A * 8/1987 Cash ..... A41D 15/00 2/105
5,341,514 A 8/1994 Dale
5,628,064 A * 5/1997 Chung ..... A41D 15/00 2/119
5,657,518 A * 8/1997 Hunt ..... A47G 25/485 24/489
6,868,558 B2 * 3/2005 Majerfeld ..... A41D 27/04 2/96
6,961,962 B1 * 11/2005 Lewis ..... A41D 13/0002 2/81
7,707,651 B2 5/2010 White
8,136,267 B2 * 3/2012 Barnett ..... A41D 15/00 24/416
8,479,315 B2 * 7/2013 Kelling ..... A41D 15/04 2/69
9,468,240 B2 * 10/2016 Lee ..... A41D 1/20
9,657,514 B1 * 5/2017 Whittemore ..... E04G 21/243
2005/0267529 A1 * 12/2005 Crockett ..... A61B 17/00234 606/215
2010/0082063 A1 * 4/2010 Yacktman ..... A45F 5/02 606/234
2010/0107300 A1 * 5/2010 Yiu ..... A41D 1/20 2/85
2010/0137887 A1 * 6/2010 Crockett ..... A61B 17/00234 606/144
2011/0113523 A1 * 5/2011 Lobas ..... A41D 3/06 2/79
2012/0103014 A1 * 5/2012 Monroe ..... A44C 15/006 63/12
2014/0189930 A1 * 7/2014 Solomon ..... A47D 13/025 2/69
2014/0245519 A1 * 9/2014 Ly ..... A44B 19/26 2/93
2015/0047090 A1 * 2/2015 Cook ..... A41D 13/0543 2/22
2015/0230526 A1 * 8/2015 Flora ..... A41D 15/04 5/413 R
2017/0079345 A1 * 3/2017 Garner ..... A41D 15/00

* cited by examiner

EXTENDER FOR AN OUTERWEAR

TECHNICAL FIELD

The present disclosure relates to an article of clothing transformable into a maternity wear and a baby carrying cover, and more particularly relates to an extender which can be conveniently attached to or detached from an outerwear for transformation purposes.

BACKGROUND

Many maternity coats are available for pregnant women which conform to girth of the women's waist during pregnancy. These maternity coats, however, do not provide the flexibility to be used after the pregnancy period. Therefore, purchase of such maternity coat is an added expense for the purpose of only using it for a short time period of pregnancy. Also, there are known various devices for carrying an infant by a person wherein the infant is safely and securely carried close to the carrying person for warmth and support, for example a front carrying device that allows the carrying person to hold the infant close to the chest of the person so that the infant is secure and comfortable and shares warmth with the person. However, with cold or other inclement weather, the use of front carrying infant devices raises a problem in that with the front seams of the person's coat spaced apart, the infant, as well as the carrying person is exposed to the inclement weather.

Further, there are some coat extenders available in the market which include zippers that secures with the corresponding zippers on regular coats and convert these regular coats to maternity coats and, in some cases, even be used as baby carrying covers, but again these products do not provide the ease of conversion from a maternity coat for use during pregnancy to a baby carrying cover for use by mother, or any other wearer, and/or back to regular coat for daily use. For example, the known coat extenders have to match up to the exact type of zipper that is on the regular coats of the consumer which sometimes poses an issue, and even if this is accomplished it can only be worn for those particular coats with which the zipper matches. Further most of these products often require different and multiple attachments for conversion purposes which makes the process cumbersome for the consumer.

Therefore, there is a need of a simple extender for the outerwear which can transform the outerwear into maternity wear as well as to be used a baby carrying cover, with relatively ease and convenience.

SUMMARY

In one aspect, the present disclosure provides an extender for an outerwear. The extender includes a first section and a second section. The first section provides a first side and a second side. The second section provides a first side and a second side. The extender also includes a fastening arrangement adapted to removably secure the second side of the first section to the second side of the second section. The extender also includes an anchoring arrangement arranged on the first side of the first section and the first side of the second section. The anchoring arrangement is adapted to removably secure the first section and the second section to first and second seams of the outerwear, respectively.

In another aspect, the present disclosure provides an article of clothing transformable into a maternity wear and a baby carrying cover. The article of clothing includes an outerwear having a first seam and a second seam defining an opening extending therebetween. The article of clothing further includes an extender having a first section and a second section. The first section provides a first side and a second side. The second section provides a first side and a second side. The extender also includes a fastening arrangement adapted to removably secure the second side of the first section to the second side of the second section. The extender also includes an anchoring arrangement arranged on the first side of the first section and the first side of the second section. The anchoring arrangement is adapted to removably secure the first section of the extender to the first seam of the outerwear and the second section to the second seam of the outerwear.

Other advantages and features of the disclosure will become apparent to persons of ordinary skill in the art upon review of the appended claims and upon review of the following detailed description of an exemplary embodiment of the invention

DETAILED DESCRIPTION

Detailed embodiments of the present disclosure are described herein; however, it is to be understood that disclosed embodiments are merely exemplary of the present disclosure, which may be embodied in various alternative forms. Specific process details disclosed herein are not to be interpreted as limiting, but merely as a basis for the claims and as a representative basis for teaching one skilled in the art to variously employ the present disclosure in any appropriate process for preparing similar food products.

Figure 1:
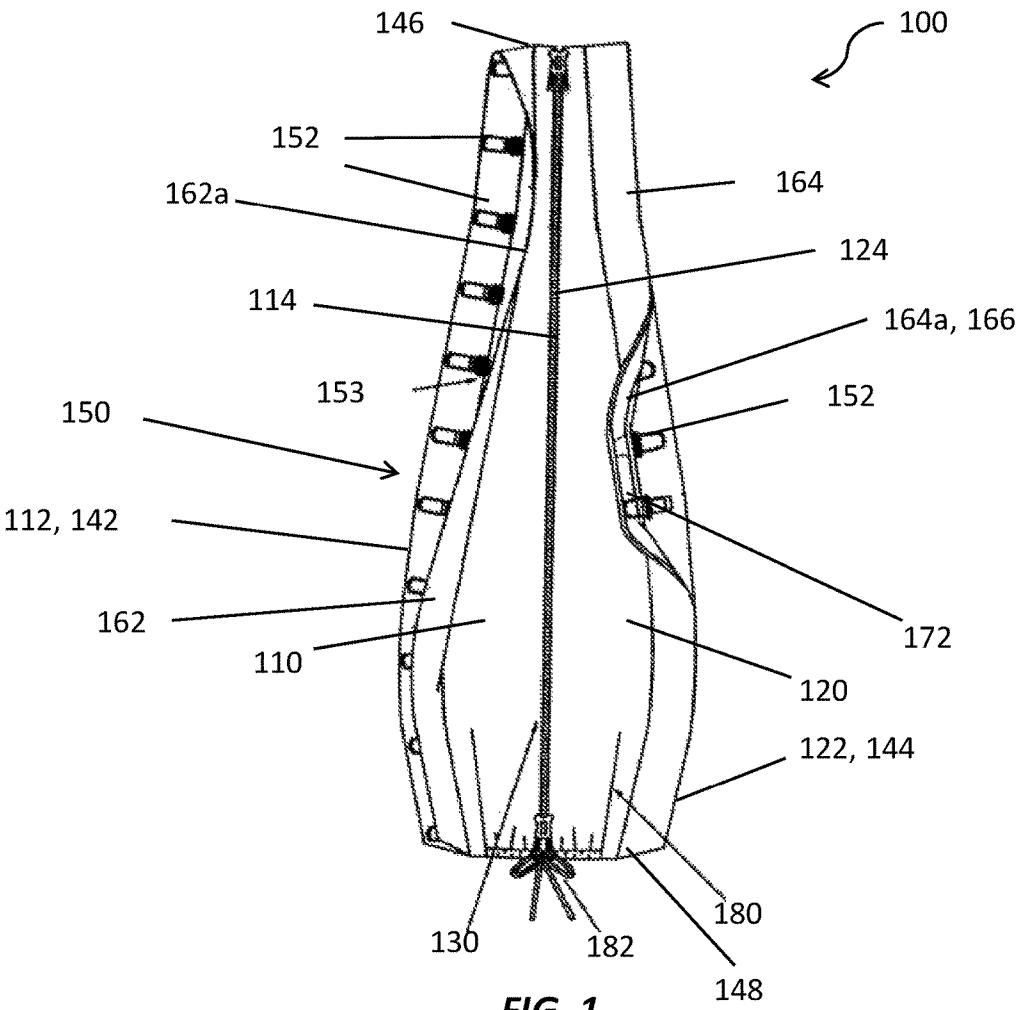
FIG. 1 illustrates a front view of an extender, in accordance with an embodiment of the present disclosure.
Figure 8:
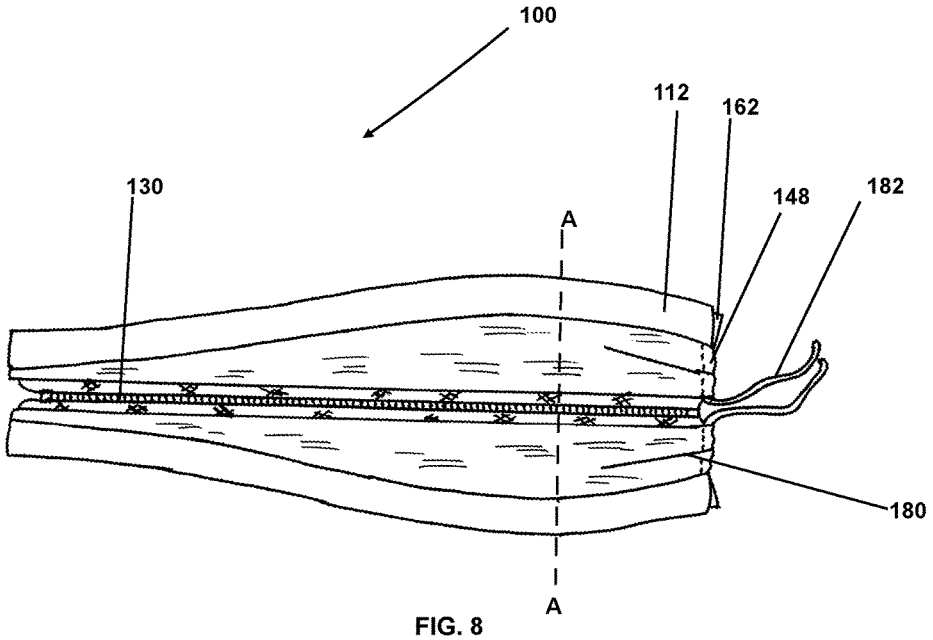
FIG. 8 illustrates a back view of the extender including a lining, in accordance with an embodiment of the present disclosure.
Figure 9:
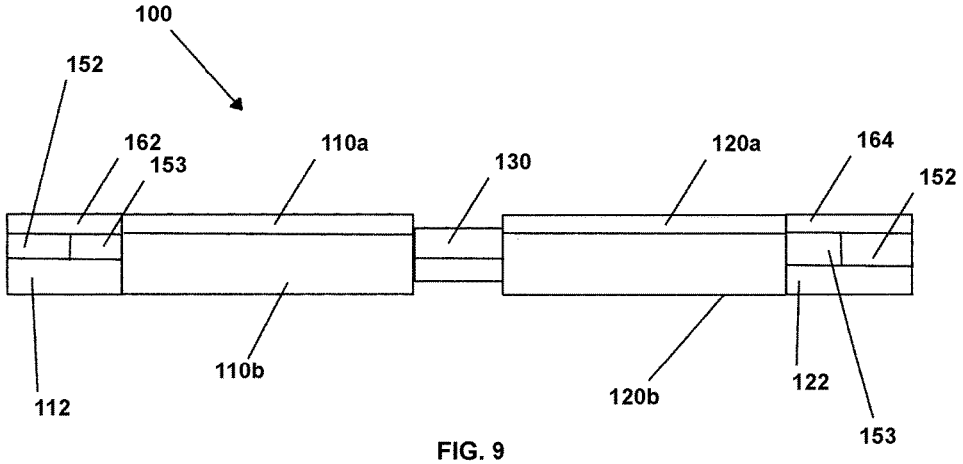
FIG. 9 illustrates a cross-section view cut at the dotted line denoted A-A in FIG. 8, as viewed towards the fourth side of the extender, in accordance with an embodiment of the present disclosure.

FIG. 1 illustrates an extender 100 in accordance with an embodiment of the present disclosure. The extender 100 may be formed of a plurality of suitable fabric that provides protection against the weather and cold from passing through. In an exemplary embodiment, there may be combination of an outer material 110*a*, 120*a*, for example a waterproof material (e.g., 3-ply nylon, 1-ply nylon, etc.) and an inner material 110*b*, 120*b* (e.g., fleece, microfleece, etc.) for the comfort of the wearer. A plurality of fabrics can be used in the present invention, for example, but not limited to 3-ply nylon, 1-ply nylon, fleece, microfleece, and a combination thereof. See, for example, FIG. 9, illustrating a cross section view of an embodiment of the extender 100, cut at the central dotted line A-A seen in FIG. 8, towards the fourth side 148 of the extender 100. FIG. 9 illustrates one embodiment of the present disclosure where the first and second sections 110, 120 are each composed of two materials 110*a*, 120*a* and 110*b*, 120*b*. FIG. 9 does not illustrate specific ratios and locations of the first and second materials. A single, weather resistant material could be used as opposed to different materials. It may be understood that the term "fabric" is used herein to indicate any substantially two-dimensional material suitable for incorporation into the surface of a garment, including rigid materials and plastic as well as woven fabrics.

Figure 2:
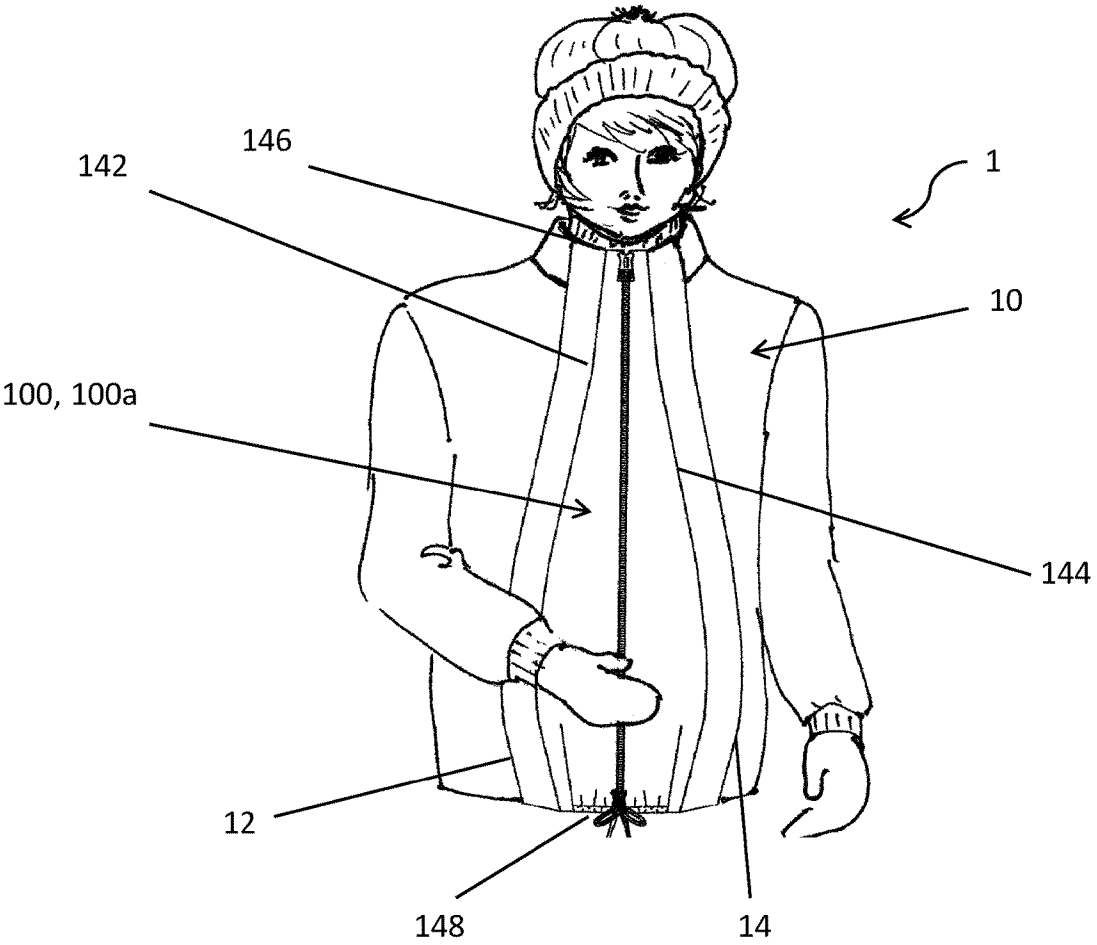
FIG. 2 illustrates a front view of an article of clothing, as a maternity wear, having the extender being used with an outerwear, in accordance with a first embodiment of the present disclosure.
Figure 3:
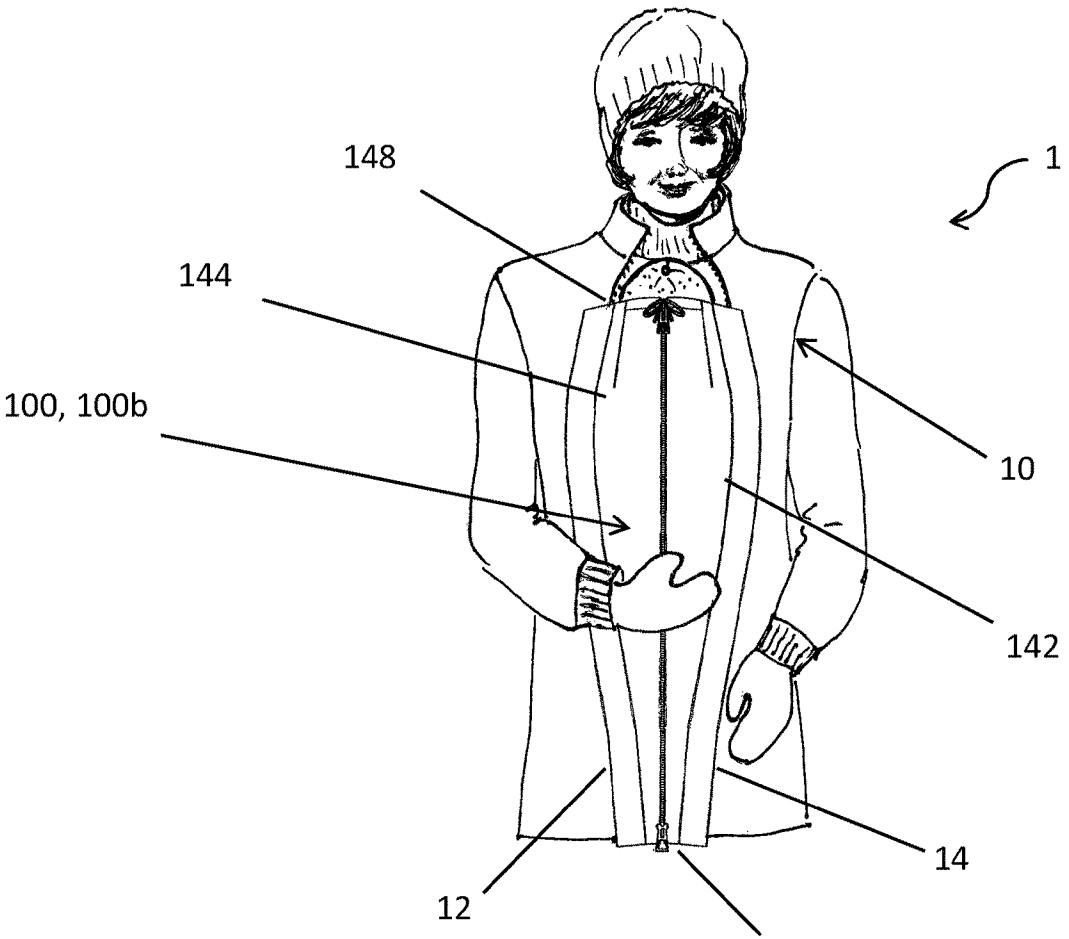
FIG. 3 illustrates a front view of the article of clothing, a baby carrying cover, having the extender being used with the outerwear, in accordance with a second embodiment of the present disclosure.

In general, FIGS. 2-3 illustrate an article of clothing, generally indicated by the numeral 1, transformable into a maternity wear 100*a* and a baby carrying cover 100*b*, depicted respectively in FIG. 2 and FIG. 3. The article of clothing 1 includes an outerwear 10 and the extender 100. The extender 100 of the present disclosure is adapted to be attached to the outerwear 10, as illustrated in FIGS. 2-3. For purposes of this application, the outerwear 10 has been described as a coat. It may be contemplated that the outerwear 10 be any garment type covering the upper body of the wearer, such as a jacket, sweater, vest, poncho, shirt, harness, or dress. The outerwear 10 is not intended to be limited to a coat or a single type of apparel, but can be used for different types of garments/apparels, just as long as the same is intended for covering the upper body of a wearer. The outerwear 10 generally includes a back portion, a neckline, a hemline and a front portion. The front portion of the outerwear 10 provides a first seam 12 and a second seam 14 defining a vertical opening (not shown) extending from the neckline to the hemline. Some conventional fastening means are employed to secure the opening in a closed configuration, for example, but not limited to, a zipper attached to the first and second seams in a zipper-type outerwear, buttons on the first seam and corresponding button-holes on the second seam in a button-type outerwear, etc.

According to an embodiment of the present disclosure, the extender 100 transforms the outerwear 10 from being a regular, daily-use coat to be used as a maternity wear 100*a* (as shown in FIG. 2), or alternatively as a baby carrying cover 100*b* (as shown in FIG. 3). It may be understood that the same extender 100 can be inverted upside down to switch between the two applications, i.e., from being a maternity wear 100*a* to a baby carrying cover 100*b*, thereby serving the said two purposes. It may be seen that the extender 100 has a vertical length that covers substantially the torso of a person so that the extender 100 can fully cover the wearer and the infant positioned at the chest of the wearer, when the extender 100 is attached to the outerwear 10.

Referring back to FIG. 1, according to one embodiment, the extender 100 of the present disclosure comprises two sections, a first section 110 and a second section 120. In general, the first section 110 and the second section 120 are of the same design and shape, and in one embodiment are somewhat mirror images of each other. In the embodiment of FIG. 1 is illustrated the first section 110 having two mutually opposite sides, a first side 112 and a second side 114. The first side 112 can be any configuration, for example, but not limited to, tapered or substantially straight. In this embodiment, the first side 112 is tapered. The second side 114 can also be in any configuration, such as, but not limited to substantially straight or tapered. In the embodiment illustrated in FIG. 1, the second side is substantially straight. Similarly, the second section 120 includes two mutually opposite sides, a first side 122 and a second side 124. These sides 122, 124 may also be in any configuration including, but not limited to substantially straight or tapered. As may be seen from the illustrated embodiment of FIG. 1, the first sides 112, 122 may be designed to provide tapered edges for the extender 100. This, in general, provides the extender 100 with two tapering edges 142, 144 extending along a vertical axis, imparting a substantially trapezoidal shape thereto.

In an embodiment, the extender 100 includes a fastening arrangement 130 to removably secure the second side 114 of the first section 110 to the second side 124 of the second section 120. In one example, the fastening arrangement 130 may be a zipper with corresponding interlocking teeth arranged on the second sides 114, 124 which can be locked with each other for attaching the two sections 110, 120 together. In an embodiment, the fastening arrangement 130 of the present disclosure may be a two-way zipper. In an alternate embodiment, the fastening arrangement 130 may include any other fastening means, such as, but not limited to, buttons on the second side 114 and corresponding button-holes on the second side 124, or snaps/hooks attached to the second side 114 and corresponding snaps/hooks receivers attached to the second side 124, hook and loop fastener straps, or the like. The first section 110 and the second section 120, when joined together by means of the fastening arrangement 130, complete the extender 100 in an assembled configuration.

For subsequent disclosure, the extender 100 has been referred to in its complete/assembled form, i.e., wherein the first section 110 and the second section 120 are joined together. In its assembled form, the extender 100 may be understood to have a first extender side 142 (previously being the first side 112) and a second extender side 144 (previously being the first side 122), along its width. In a further embodiment, the extender 100 may be configured to have a third extender side 146 and a fourth extender side 148, along its length. Further, it may be understood that the tapered edges, as provided by the first sides 112, 122 are generally imitated, and in this embodiment are configured to be in tapered form of the first extender side 142 and the second extender side 144. As illustrated, the first and second extender sides 142, 144 extend between the third extender side 146 and the fourth extender side 148, and thereby making the third extender side 146 as a short side and the fourth extender side 148 as a long side. Also it may be contemplated that in first orientation (depicted as extender 100*a*), as shown in FIG. 2, the third extender side 146 forms the narrower top of the extender 100 and the fourth extender side 148 forms the broader bottom of the extender 100. And in second orientation (depicted as extender 100*b*), as shown in FIG. 3, the third extender side 146 forms the narrower bottom side of the extender 100 and the fourth extender side 148 forms the broader top side of the extender 100.

The extender 100 may also be configured to include an anchoring arrangement 150 to removably secure the first extender side 142 and the second extender side 142 to the outerwear 10. In particular, the anchoring arrangement 150 independently and reversibly secures the extender sides 142, 144 to the first seam 12 and the second seam 14 of the outerwear 10, respectively. This allows for the extender 100 to be attached to the outerwear 10 in both first and second orientations, as discussed above, further illustrating the versatility of the extender. In an embodiment of the present disclosure, the anchoring arrangement 150 includes a plurality of clips 152 arranged along the length of the first and second extender sides 142, 144. In other words, the plurality of clips 152 are arranged on the first side 112 of the first section 110 and the first side 122 of the second section 120. In an embodiment, the plurality of clips 152 may be sewn on a ribbon 153, made of, for example, twill tape, provided on the first and second extender sides 142, 144. The plurality of clips 152 is not intended to be, and should not be so limited, sewn only on a ribbon but may also be sewn on any portion of the first and second extender sides 142, 144 which can accommodate the same securely.

Figure 5:
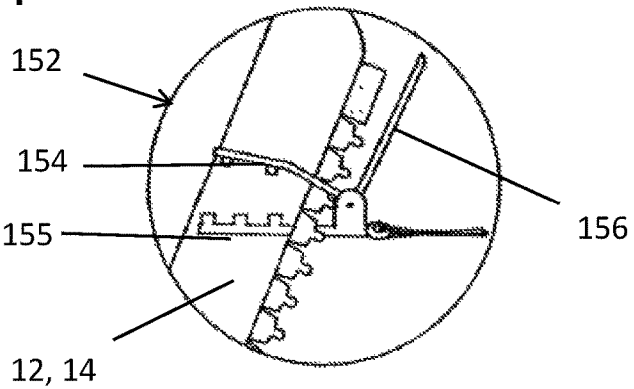
FIG. 5 illustrates a side view of the clip grasping a seam of the outerwear, in accordance with an embodiment of the present disclosure.
Figure 4:
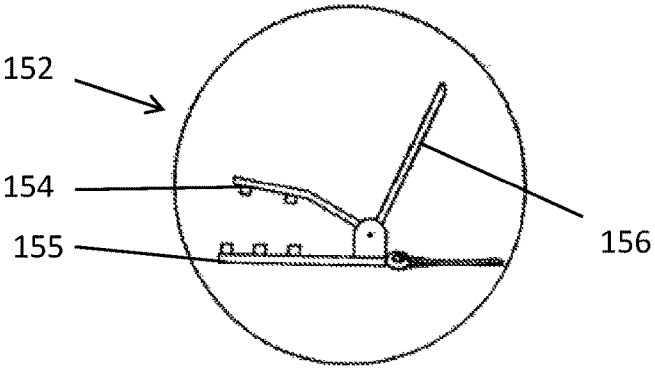
FIG. 4 illustrates a side view of a clip, in an open position, in accordance with an embodiment of the present disclosure.

Further, as illustrated in FIGS. 4-5, each of the plurality of clips 152 includes an upper protrusion 154 and a lower protrusion 155 which may be opened or closed by pressing or releasing a lever 156, respectively. The lever may be any type of device understood to open and/or close such a feature, such as, but not limited to a handle. To close the protrusions 154, 155 onto the seam 12, 14 the lever 156 is pressed down. To release the protrusions 154, 155 from the seam 12, 14 or "open" the protrusions 154, 155 the lever is lifted up. In use, it is contemplated that the protrusions 154, 155 may grasp tapes of zippers provided at the two seams 12, 14 of the outerwear 10, such as in case of zipper-type outerwear. This is illustrated in FIG. 5. In one embodiment, with button-type outerwear 10, the protrusions 154, 155 directly grasp the seams 12, 14, for attaching the extender 100 to the outerwear 10. In another embodiment, with zipper-type outerwear 10, the protrusions 154, 155 may include protective gel teeth in order to prevent any damage to the fabric around the seams 12, 14 of the outerwear 10 when the plurality of clips 152 are attached thereto.

In the embodiment, illustrated in FIG. 1, the extender 100 further includes two flaps, a first flap 162 and a second flap 164. The first flap 162 and the second flap 164 substantially cover the first extender side 142 and the second extender side 144, respectively. In other words, the first flap 162 and the second flap 164 substantially cover the first side 112 of the first section 110 and the first side 122 of the second section 120, respectively. The flaps 162, 164 are arranged in a manner to substantially prevent any air to pass through, between the gaps where the plurality of clips 152 are attached to the outerwear 10. The flaps 162, 164 protect the wearer (and child) from harsh weather. The plurality of clips 154 are also protected from harsh weather, which reduces the likelihood of damage, thus preventing deterioration of materials and boosting confidence in the reliability of the outerwear 10. Moreover, by preventing deterioration, when using the extender 10 in the baby cover embodiment, there is little to no risk of exposing a baby to rusty or freezing, or wet clips 154. In some embodiments, the extender 100 includes a third flap (not shown) under the fastening arrangement 130 (i.e., between the wearer and the extender 100). The third flap provides additional protection from harsh weather and protects the wearer (and child) from rough portions of the fastening arrangement 130.

Figure 6:
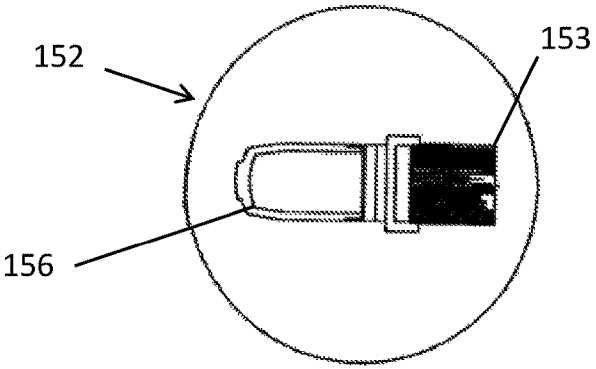
FIG. 6 illustrates a top view of the clip, in accordance with an embodiment of the present disclosure.

In an embodiment, the extender 100 may also include a plurality of pockets 172 formed on an inner side 162*a* of the first flap 162 and an inner side 164*a* of the second flap 164. The pockets 172 are formed by, for example, folding the first flap 162 and sewing a stitching line about ¾ inches away from an edge of the first flap 162 then stitched down into pockets. The lever 156 (more clearly illustrated in FIGS. 6-7) of each of the plurality of clips 152 is adapted to be received within the plurality of pockets 172. This is done in order to hold the first flap 162 and the second flap 164 substantially close with respect to the first and second extender sides 142, 144 and/or the outerwear 10. When the flaps 162, 164 are substantially close to the extender sides 142, 144 less air is allowed to pass between the gaps where the plurality of clips 152 reside in the outerwear 10 (thus improving the comfort of the wearer and child). In another embodiment, the extender 100 also includes a patch 166 of fabric attached to and extending along the inner side 162*a* of the first flap 162. Similarly, another patch (not shown), may be attached to and extending along the inner side 164*a*, of the second flap 164. The patch 166 should be made of any seam stabilizer, and can be, but is not limited to, for example twill tape. The plurality of pockets 172 may be formed on the patch 166 to avoid any direct tear in the flaps 162, 164.

Figure 7:
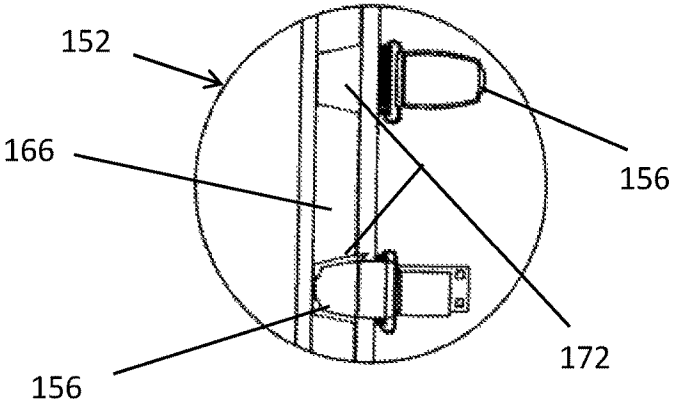
FIG. 7 illustrates a top view of two clips with respect to two pockets, the clips being appended to the seam of the outerwear, in accordance with an embodiment of the present disclosure.

FIG. 7 illustrates a clip 156 in an open configuration and a clip 156 in a closed configuration (upper and lower depictions, respectively). In the open configuration, the protrusions 154, 156 are not anchored to a seam 12, 14, and the lever 156 is not received by the pocket 172. In the closed configuration, the lever 156 is received (i.e., pressed down against) by the pocket 172. The reception of the lever 156 by the pocket 172 draws the flaps 162, 164 substantially close to the first and second sections 110, 120, respectively.

In an embodiment, the extender 100 may also include darts 180 adapted to provide a shape to the extender 100. As illustrated, the darts 180 may be provided at the fourth extender side 148 which forms the bottom area of the extender 100*a*, as shown in FIG. 2. The darts 180 contour the extender 100*a* to a shape of a belly of the wearer when attached to the outerwear 10 to form the maternity wear. Not only could this provide a more tailored look, but in addition, could provide a closer fit thereby potentially keeping the wearer and if used to include an infant, then keep an infant, warmer due to a closer fit. In another embodiment, the darts 180 may be replaced by seams, pleats, gathers or the like. Further, in an embodiment, the extender 100 includes an adjusting arrangement 182 to adjust the width of the fourth extender side 148, i.e., bottom of the extender 100*a*, as shown in FIG. 2. For example, the adjusting arrangement may adjust the width of the fourth extender side 148 within a range of 8 inches to 15.5 inches (depending on the woman's waist). In another embodiment, the tie cord 182 may be replaced by a pull toggle or the like. In some embodiments, the extender 100 includes a second adjusting arrangement (not shown) between the third extender side 146 and the fourth extender side 148 (e.g., near the woman's chest when the extender 100 is worn). The second adjusting arrangement may adjust the width of a portion of the extender 100 within a range of 6 inches to 11.5 inches (depending on the woman's chest).

Also, the extender 100 may include a hood accessory (not shown) provided on the fourth extender side 148. The hood accessory may be used to cover a head of the baby positioned inside the baby carrying cover configuration of the outerwear 10, as provided by the extender 100*b*, as shown in FIG. 3. In one example, the hood accessory may be detachable from the extender 100.

INDUSTRIAL APPLICABILITY

The present disclosure provides the extender 100 which can be clipped on to the outerwear 10 to transform it into a maternity wear 100*a* (shown in FIG. 2) or alternatively as a baby carrying cover 100*b* (shown in FIG. 3). The present extender 100 is versatile and can simply be inverted and then attached to outerwear 10 to switch between the two applications. The fastening arrangement 130 (e.g., a two-way zipper) enables the wearer to zip and unzip the front in either direction when the extender 100 is required to be inverted, for example from extender 100*a* to extender 100*b*. As most baby carrying covers are shorter than the maternity wear, the present extender 100 provides for the extra length as shown by the extender 100*b*, on the lower part, which can be adjusted to make it substantially even with the hemline of the outerwear 10. This can be achieved easily with the clips 152 of the present disclosure, as opposed to zippers of the known products, by folding up and using the extra clips 152 to secure the lower part in the fold to clip to the inside of the extender 100.

In the present extender 100, the fastening arrangement 130 allows the wearer to get out of the outerwear 10 while the extender 100 (in disassembled form as sections 110, 120) remains attached thereto. This conveniently provides that the outerwear 10 can be opened which may be frequently required, for example, to check on baby, etc. without completely removing the extender 100. Also, there is less wear and tear on the outerwear 10 as there is no repeated clipping and unclipping of the clips 152. Further, the fastening arrangement 130 allows for easy attachment of the extender 100 to the outerwear 10, as the sections 110, 120 can be separately and independently attached thereto.

The plurality of clips 152 allows the extender 100 to attach to the tape of the zipper (for example, of the zipper-type outerwear) or directly at the seams (for example, of the button-type outerwear) of the outerwear 10. In other words, the extender 10 can be universally used on outerwear 10 having different closures. Therefore, there is no need to match to any particular kind of closures or even zippers of the outerwear 10. In the present extender 100, the plurality of clips 152 have been arranged to be closely spaced to have smaller gaps therebetween, to prevent cold air from entering the inside of the outerwear 10. Further, the provided pockets 172 configure the flaps 162, 164 in a position such that the clips 152 are hidden, while simultaneously holding those flaps 162, 164 substantially close (i.e., tightly down), to further prevent cold air from entering the inside of the outerwear 10. Further, the patch 166 (e.g., twill tape) allow for easy sewing of the clips 152 and formation of pockets 172 without affecting the fabric of the extender 100.

The terms and descriptions used herein are set forth by way of illustration only and are not meant as limitations. Examples and limitations disclosed herein are intended to be not limiting in any manner, and modifications may be made without departing from the spirit of the present disclosure as defined in the appended claims. Those skilled in the art will recognize that many variations are possible within the spirit and scope of the invention as defined in the following claims, and their equivalents, in which all terms are to be understood in their broadest possible sense unless otherwise indicated.

We claim:

1. An extender for an outerwear, the extender comprising:
a first section having a first side and a second side;
a second section having a first side and a second side;
a fastening arrangement adapted to removably secure the second side of the first section of the extender to the second side of the second section of the extender in an assembled configuration, wherein opening the fastening arrangement disassembles the first section from the second section into a disassembled configuration wherein the outerwear including the extender in the disassembled configuration is adapted to be removable by a wearer while the extender remains attached to the outerwear; and
an anchoring arrangement arranged on the first side of the first section of the extender and the first side of the second section of the extender, the anchoring arrangement adapted to removably secure the first section of the extender to a first seam of the outerwear and the second section of the extender to a second seam of the outerwear, wherein the anchoring arrangement comprises:
a plurality of clips arranged on the first side of the first section and the first side of the second section; wherein
each of the plurality of clips comprises an upper protrusion and a lower protrusion, wherein the upper protrusion and the lower protrusion of each of the plurality of clips comprise gel teeth for contacting the first and second seams of the outwear; wherein
each of the plurality of clips further comprises a lever operable to actuate the upper protrusion and the lower protrusion to removably secure the first section and the second section to the first and second seams of the outerwear; and wherein the extender further comprises:
a first flap attached to the first section; and
a second flap attached to the second section; wherein
the first flap is adapted to substantially cover the first side of the first section and the second flap is adapted to substantially cover the first side of the second section.

2. The extender of claim 1, further comprising a plurality of pockets formed on an inner side of the first flap and an inner side of the second flap, wherein one of the plurality of clips are received by one of the plurality of pockets.

3. The extender of claim 1, wherein the lever of each of the plurality of clips is adapted to be received by one of the plurality of pockets formed on the inner side of the first flap and the inner side of the second flap to hold the first flap substantially close to the first section and the second flap substantially close to the second section.

4. An extender for an outerwear, the extender comprising:
a first section having a first side and a second side;
a second section having a first side and a second side;
a fastening arrangement adapted to removably secure the second side of the first section of the extender to the second side of the second section of the extender in an assembled configuration, wherein opening the fastening arrangement disassembles the first section from the second section into a disassembled configuration wherein the outerwear including the extender in the disassembled configuration is adapted to be removable by a wearer while the extender remains attached to the outerwear;
an anchoring arrangement arranged on the first side of the first section of the extender and the first side of the second section of the extender, the anchoring arrangement adapted to removably secure the first section of the extender to a first seam of the outerwear and the second section of the extender to a second seam of the outerwear, wherein the anchoring arrangement comprises a plurality of clips arranged on the first side of the first section and the first side of the second section, wherein each of the plurality of clips comprises an upper protrusion and a lower protrusion, and wherein the upper protrusion and the lower protrusion of each of the plurality of clips comprise gel teeth for contacting the first and second seams of the outwear; and a hood accessory operable to attach to the extender.

* * * * *